United States Patent [19]

Nilsson

[11] Patent Number: 4,602,445

[45] Date of Patent: Jul. 29, 1986

[54] LOCKING DEVICE

[75] Inventor: Ove Nilsson, Örebro, Sweden

[73] Assignee: AB Bofors Wear Parts, Bofors, Sweden

[21] Appl. No.: 656,848

[22] Filed: Oct. 2, 1984

[30] Foreign Application Priority Data

Oct. 4, 1983 [SE] Sweden ..... 8305436

[51] Int. Cl.[4] ..... E02F 9/28

[52] U.S. Cl. ..... 37/142 A; 172/753; 403/379

[58] Field of Search ..... 37/141 R, 141 T, 142 R, 37/142 A; 74/527; 172/753, 713, 777; 403/379

[56] References Cited

U.S. PATENT DOCUMENTS

| | | | |
|---|---|---|---|
| 2,427,651 | 9/1947 | Baer | 74/527 X |
| 2,870,667 | 1/1959 | Murtaugh | 37/142 R X |
| 3,106,256 | 10/1963 | McBride | 37/142 A X |
| 3,368,293 | 2/1968 | Judkins et al. | 37/142 R |
| 3,894,349 | 7/1975 | Moreau | 37/142 A |
| 4,342,166 | 8/1982 | Johnson et al. | 37/142 A |

*Primary Examiner*—Edgar S. Burr
*Assistant Examiner*—Moshe I. Cohen
*Attorney, Agent, or Firm*—Pollock, Vande Sande & Priddy

[57] ABSTRACT

This invention refers to a locking device (14) for a wear-parts system (1) and (2) for earth moving machines. The locking device (14) consists of a rigid lock bolt (17) connected to a lock catch (19) which is intended to prevent the lock bolt (17) falling out after it has been fitted in the lock opening (12, 13) for this purpose where it prevents the different parts (1) and (2) of the wear-part from moving relative to each other. According to this invention the lock catch (19) is designed so that it can be easily fitted in position together with the lock bolt (17) and there provide the best possible locking action. On the other hand no regard has been paid to the lock catch (19) being able to be loosened from the outside in order to remove the lock bolt (17). Instead a breaking point (29) has been provided along the fixation of the lock catch (19) in the lock bolt (17). The breaking point (29) makes it possible by means of subjecting the lock bolt (17) to forces e.g., from blows from a heavy hammer, in the longitudinal direction of the lock bolt (17) to load the connection between the lock bolt (17) and the lock catch (19) until it shears. The latter remaining in the lock opening (12, 13, 15, 16) when the lock bolt is forced out of the opening.

9 Claims, 6 Drawing Figures

LOCKING DEVICE

BACKGROUND OF THE INVENTION

This invention relates to a locking device for wear-parts of tools for earth moving machines such as excavating machines, mechanical diggers, mechanical loaders, and dredgers etc. By wear parts for earth moving machines is meant teeth, cutting edges, front edges of scoops, road scraper blades, track shoes, etc. Common to all these wear-parts is that they are subjected to extreme wear by the material being worked and consequently they must be easy to replace. Usually the tools are therefore fitted with special holders into which the wear-parts proper are fitted. Even if the holders are only intended to be replaced in exceptional circumstances, they are usually regarded as wear-parts. The holders and the wear-parts proper are usually connected together by means of male and female units suited to each other and located in the area between the holder and the weap-part. When connected together the relative movement between the holder and the wear-part is locked by means of a locking device fitted in an opening running at right-angles to the direction of connection and formed for this purpose. In principle the locking device consists of a lock bolt and a lock catch which prevents the lock bolt from falling out after it has been fitted in place in the opening for this purpose. The lock catch can be an independent part fixed in the holder or the wear-part proper, or it can even be an integral part of the lock bolt. Most often the function of the lock catch is based on the elastic deformation of a piece of hard rubber or a steel spring. The elastic part of the lock catch is compressed when the lock bolt is forced into the opening for this purpose and it can be deformed again when the lock bolt is forced out of the opening. Normally this is done by driving the lock bolt in or out of the opening by means of blows from a heavy hammer. When the lock bolt is to be driven out, a mandrel is usually located between the lock bolt and the hammer. An example of a locking device with separate lock catch fixed in a holder is to be found in U.S. Pat. No. 2,427,651. The Swedish Pat. No. 333 551 shows a representative example of a locking device with a built-in lock catch.

Locking devices with built-in or separate lock catches can be made to function satisfactorily in most conditions, but in particularly adverse conditions it can happen that the lock catch is unable to prevent the lock bolt working its way out of the lock opening. Wear-parts are namely mass produced preferably by means of forging or casting with a minimum of machining afterwards and it is therefore practically impossible to avoid play between the parts at the same time as the parts are subjected to great forces and vibrations.

SUMMARY OF THE INVENTION

This invention refers to a type of locking device that cannot vibrate loose but for this sake is no more difficult to remove than existing types.

The basic principle for the locking device according to this invention means that it consists of a rigid lock bolt coupled to an elastic, deformable lock catch that can be deformed sufficiently so that the lock bolt and lock catch can be entered into an opening adapted for this purpose and running at right-angles to the direction of connecting the units of the wear-parts together. Once in position in the lock opening the lock catch shall spring backwards and effectively prevent the lock bolt from falling out. Consequently the lock catch is formed only to be entered into the lock opening and to keep the lock bolt in position. Previously it has been necessary to design lock catches that could even be elastically deformed when the lock bolt was being removed. This caused the design of angled chamfered locking surfaces running in the longitudinal direction of the lock bolt which sometimes, under particularly adverse conditions, caused the lock bolt to work itself loose and fall out. In other designs the lock bolts were difficult to fit and in others difficult to remove.

The locking device according to this invention consists of a rigid lock bolt connected to a lock catch formed so as to fix the lock catch as effectively as possible without regard to how the locking surfaces of the lock catch can be removed from the locking position adopted. This invention is based namely on the fact that the connection between the lock catch and the lock bolt offers a breaking point along which they can be separated from each other on condition that the lock bolt is influenced longitudinally by one or more sufficiently hard blows from a heavy hammer. Consequently the connection between the lock bolt and the lock catch is best formed so that it shears off when struck by blows from a hammer. This is to say that the lock bolt is driven out of the lock opening while the lock catch remains inside to be removed later prior to fitting a new locking device. This new design principle means that the lock catch is best made from an elastic, deformable plastic e.g., polyamide, while the lock bolt is best made of steel. A good basic form of lock catch would be one with two protrusions in both directions along the lock bolt each of which terminates in its own locking surface and which meet in the centre of the lock catch there forming a boss which is pressed firmly into an opening in the lock bolt and is sheared when the lock bolt is to be removed.

The locking device according to this invention is defined in the patent claims and will now be defined in more detail in conjunction with the example illustrated in the enclosed drawings.

BRIEF DESCRIPTION OF THE DRAWINGS

FIG. 3 shows a vertical view of the locking device shown in FIG. 2 while

DESCRIPTION OF THE PREFERRED EMBODIMENT

Figure 1:
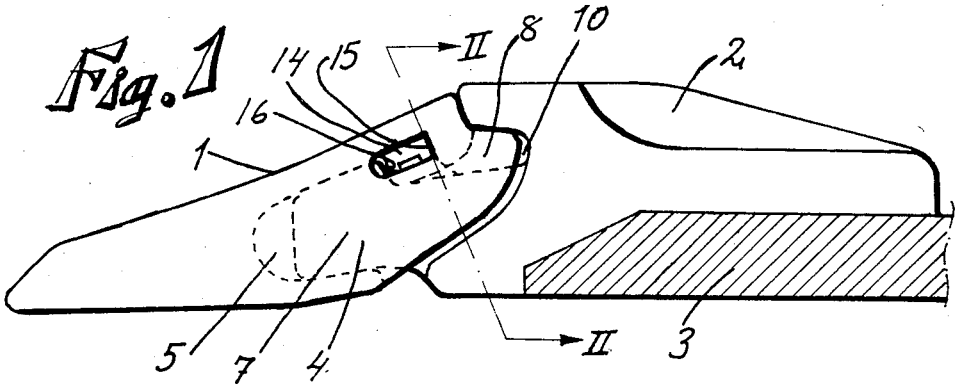
FIG. 1 shows a side projection of a tooth for a mechanical loader.

The wear-parts system shown in FIG. 1 consists of a tooth (1) for a mechanical loader fitted in a holder (2) which in its turn is welded to the bottom (3) of a mechanical loader scoop. The holder (2) is provided with a protruding male unit (4) while the tooth (1) has a cavity or female unit (5). The male and female units are adapted to suit each other and when the tooth (1) is fitted in its holder (2) the female unit (5) ensheaths the male unit (4) by two side walls (6) and (7). The side walls ensheath the male unit along its sides. In addition to the male and female units there are also special bosses (8) and (9) (the latter is not shown in the figure) on the tooth which when the tooth is fitted in the holder are entered into the grooves (10) and (11) in the holder (the latter groove is not shown in the figure). In each of the side walls (6) and (7) there are the openings (12) and (13) respectively. The openings are for the locking device (14) which via either of its openings can be entered between the facing locking surfaces (15) and (16) in the tooth and holder. Once in place the locking device bridges the gap between the locking surfaces (15) and (16) thus preventing the tooth (1) and holder (2) from being moved relative to each other.

The locking device (14) consists of a curved, rigid lock bolt (17) of steel with a more or less rectangular cross-section and having a groove (18) in its bottom side. In the groove (18) there is a special lock catch (19) fitted. The lock catch (19) is fixed in the lock bolt (17) by means of a groove (20) intersected cylindrical boss (21) which terminates in a heel (22). The boss (21) is pressed into a hole (23) specially adapted for this purpose in the lock bolt (17). For the heel (22) there is a special recess (24) in the hole (23). The lock catch (19) extends from the boss (21) via two spring arms (25) and (26) outwards to each side. Each of the said spring arms terminates in the locking surfaces (27) and (28).

Figure 2:
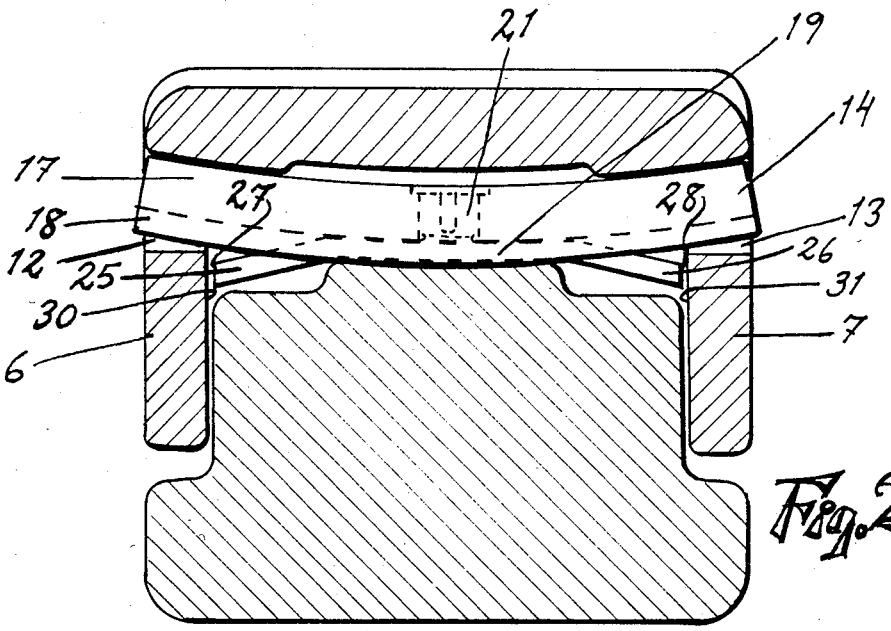
FIG. 2 shows in double scale a section along II—II in FIG. 1.
Figure 4:
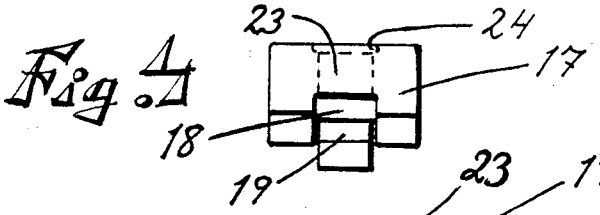
FIG. 4 shows an end view of the same locking device.
Figure 3:
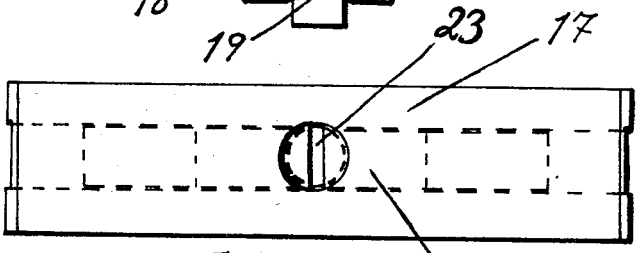
Figure 5:
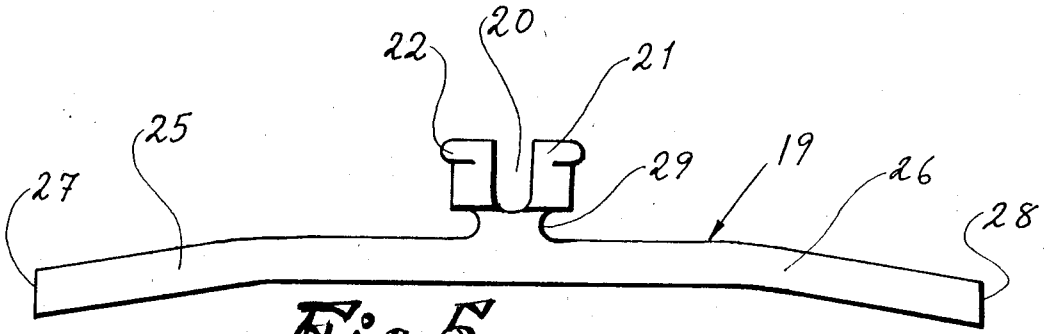
FIGS. 5 and 6 show in double scale a side projection and a vertical view of the lock catch included in the locking device as shown in FIGS. 2–4.
Figure 6:
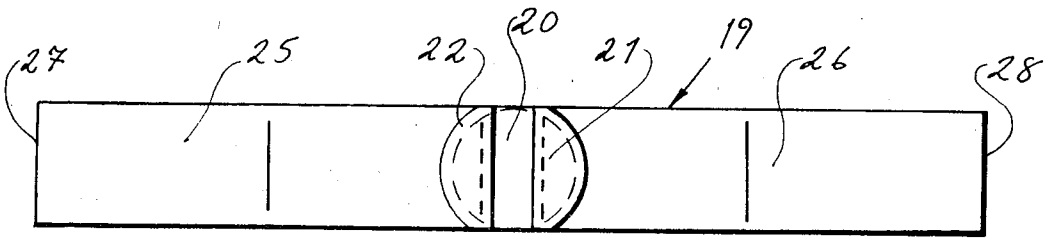

When the lock catch (19) together with its boss (21) is fitted in the hole (23) in the lock bolt adapted for this purpose both spring arms of the lock catch shall extend along the groove (18). The greater part of the lock catch spring arms (25) and (26) will then be in the groove (18) but their ends containing the locking surfaces (27) and (28) will protrude from the bottom of the lock bolt (17). The latter is a direct result of the lock bolt (17) being curved and the spring legs (25) and (26) of the lock catch (19) being angled downwards and outwards from the boss (21). As can be seen in FIG. 2 the locking surfaces (27) and (28) will lock the tooth sides (6) and (7) against the facing inner surfaces (30) and (31) immediately to the side of the openings (12) and (13) when the locking device (14) is fitted in place. The locking surfaces (27) and (28) are parallel with the inner surfaces (30) and (31). To get the locking device (14) into this position the leg of the lock catch at that end of the locking device (14) that is first entered into one of the lock openings must be pressed into the groove (18). When the locking device (14) has been fitted in position access is denied to the arms (25) and (26) of the lock catch (19) preventing them being pressed into the groove and releasing the locking action of the surfaces (27) and (28).

Consequently the lock catch boss (21) is provided with a shearing zone (29) along which the boss can be sheared off by means of subjecting the lock bolt (17) to great force in a longitudinal direction e.g., by several heavy blows from a hammer. Shearing zone (29) is perhaps not always necessary but the function is always the same. The lock catch (19) shall lock so effectively that the locking device (14) cannot be removed without the connection between the lock catch (19) and the lock bolt (17) being subjected to such force that it shears. The lock bolt can then be removed from the tooth (1), disassembled and the parts of the lock catch removed from the locking groove prior to fitting a new tooth.

Steel lock bolts can be used several times as it is easy to replace the sheared lock catch (19) by simply pressing a new one into the hole (23) whereupon the boss of the previous lock catch is simultaneously pressed out of the hole (23). It is proposed that the lock catch (19) be made of a plastic having an adequate sufficiency of elasticity and which when it is sheared off leaves a clean section. Polyamide has been used with good results. The force required to load the connection between the lock catch and the lock bolt until it shears cannot be created by the work of the wear-part but must be purposely created for this purpose with a view to removing the lock bolt.

The above description is only one example of how the principle of this invention may be applied.

I claim:

1. A locking device for connecting a wear-part to a holder in an earth moving type machine, each part having an opening, said openings after being aligned defining a lock opening running at right angles with respect to said wear-part's direction of connection, said locking device after being fitted into said lock opening preventing said parts from being moved relative to each other, said locking device comprising a rigid lock bolt for performing locking action and an associated lock catch for preventing said lock bolt from being displaced from said lock opening; said lock catch comprising a locking portion having deformable locking parts and a fixation portion being shearably connected to said locking portion, and adapted to secure said catch in said bolt; said lock catch together with said lock bolt being inserted into said lock opening while said locking portion is resiliently deformed and once being therein said deformable locking parts of said lock catch spring back to retain said lock bolt in position; said locking device being releasable only by shearing said fixation portion from said locking portion due to a force acting on the lock bolt in its longitudinal direction.

2. A locking device according to claim 1 wherein said lock bolt has substantially a rectangular cross-section and a groove along one side into which said lock catch thereof when deformed can be completely fitted but, when non-deformed, said locking surfaces protrude from said groove.

3. A locking device according to claim 1 wherein said lock bolt is made of steel and said lock catch is made of an elastic, deformable plastic.

4. A locking device according to claim 1 wherein said lock catch in its locking portion is provided with two locking surfaces facing away from each other but facing towards both ends of said lock bolt which after the lock bolt is fitted into said lock openings cooperate with the surfaces of said lock openings.

5. A locking device according to claims 1 or 4 wherein said lock catch further comprises a shearing zone located between said locking portion and said fixation portion.

6. A locking device according to claim 5 wherein said locking portion of said lock catch is provided with two spring arms extending towards both ends of the lock bolt and terminating each with its own locking surface and level with the center of the lock bolt join with said fixation portion, said fixation portion further comprising a boss, and said lock bolt comprising an opening located therein for engaging said boss into said opening, said boss having a shearing zone level with the bottom surface of the lock bolt for the purpose of shearing said boss from said locking portion of said lock catch.

7. A locking device according to claim 6 wherein said boss further comprises two spring legs each terminating in a heel wherein said legs are intended to press against the sides of said opening, said opening further comprises cavities and wherein said heels are adapted to enter into said cavities.

8. A locking device according to claim 7 wherein said lock bolt has substantially a rectangular cross-section and a groove along one side into which said lock catch thereof when deformed can be completely fitted but, when non-deformed, said locking surfaces protrude from said groove.

9. A locking device according to claim 8 wherein said lock bolt is made of steel and said lock catch is made of an elastic, deformable plastic.

* * * * *